US008662493B2

(12) United States Patent
Yano

(10) Patent No.: US 8,662,493 B2
(45) Date of Patent: Mar. 4, 2014

(54) PRINTING SYSTEM, PRINTING SYSTEM CONTROL METHOD, AND STORAGE MEDIUM

(75) Inventor: Takaaki Yano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/597,098

(22) Filed: Aug. 28, 2012

(65) Prior Publication Data

US 2013/0058663 A1 Mar. 7, 2013

(30) Foreign Application Priority Data

Sep. 1, 2011 (JP) ..... 2011-190738

(51) Int. Cl.
*B65H 3/44* (2006.01)
*B65H 5/26* (2006.01)

(52) U.S. Cl.
USPC ..... 271/9.01; 271/9.02; 271/9.03; 271/9.05; 271/9.06

(58) Field of Classification Search
USPC ..... 271/9.01–9.03, 9.05, 9.06
See application file for complete search history.

(56) References Cited

U.S. PATENT DOCUMENTS 5,105,229 A * 4/1992 Ozaki ..... 399/17

FOREIGN PATENT DOCUMENTS

| | | | |
|---|---|---|---|
| JP | 61023048 A | * | 1/1986 |
| JP | 01-256434 A | | 10/1989 |
| JP | 2000-229738 A | | 8/2000 |
| JP | 2009-256076 A | | 11/2009 |

* cited by examiner

*Primary Examiner* — Prasad Gokhale
(74) *Attorney, Agent, or Firm* — Canon U.S.A., Inc., IP Division

(57) ABSTRACT

A user is notified that the setting of sheets with respect to a grouped plurality of sheet storage units is changed, so that a state becomes impossible to execute switching of the grouped sheet storage units. The control method includes, registering a plurality of sheet storage units each storing a sheet as one group, determining, at the time of sheet supply to any one of the sheet storage units, whether sheet information about the sheet storage unit set in the group has been changed by sheet information newly set with respect to the sheet storage unit to be supplied with the sheet, and a notifying, when it is determined that the sheet information has been changed, the user of the change in the sheet information about the sheet storage units set as one group by the supply of the sheet.

12 Claims, 6 Drawing Sheets

FIG. 4

SHEET SUPPLY WARNING LEVEL

CHECK CONDITIONS OF WARNING DISPLAY AT THE TIME OF SHEET SUPPLY.

- [x] NUMBER OF KINDS OF SHEET IS REDUCED.
- [ ] NUMBER OF KINDS OF SHEET IS INCREASED.
- [x] NUMBER OF SHEET STAGES IS REDUCED TO 1.

PRINTING SYSTEM, PRINTING SYSTEM CONTROL METHOD, AND STORAGE MEDIUM

BACKGROUND OF THE INVENTION

1. Field of the Invention

The present invention relates to a printing system, a printing system control method, and a storage medium.

2. Description of the Related Art

In a printing system, a method in which when performing copying or printing, a sheet feeding cassette is explicitly designated, and printing or copying is performed by using a sheet from the desired sheet feeding cassette is known. In a printing system having a plurality of sheet feeding cassettes, when executing a print job with the sheet feeding cassette designated, printing may be interrupted if sheet feeding becomes impossible due to running out of sheets of the designated sheet feeding cassette. Japanese Patent Application Laid-Open No. 01-256434 discusses a method in which to solve the above problem, an auto cassette change (ACC) function can automatically switch the sheet feeding destination to a sheet feeding cassette supplied with the same kind of sheets as the designated sheet cassette.

Further, Japanese Patent Application Laid-Open No. 2000-229738 discusses a method in which grouping is effected on sheet feeding cassettes, and th ACC is effected within a set group. Further, Japanese Patent Application Laid-Open No. 2009-256076 discusses a method in which any sheet feeding cassette involving incompatibility in sheet attribute is automatically removed from the group, thereby preventing printing from being stopped due to incompatibility in sheet attribute.

In such a printing system, with respect to the sheet feeding cassette that are limited entity, it is up to the user to decide what kind of attribute the sheets have, and to which sheet feeding cassette the user supply the sheets. In an image forming apparatus which is utilized by a plurality of users, the kind of sheet to be utilized differs from user to user. Thus, it frequently occurs that a user changes the sheets of each sheet feeding cassettes so as to match them to user's own purposes. When a sheet combination of sheet feeding cassettes set by a user for the execution of ACC is changed by another user, the first user is disabled to perform printing in the manner he has originally expected, with the printing being interrupted without execution of the ACC function.

On the other hand, in the techniques discussed in Japanese Patent Application Laid-Open No. 01-256434 and in Japanese Patent Application Laid-Open No. 2000-229738, ACC is executed so as to avoid as far as possible the generation of printing interruption within a previously set sheet feeding cassette sheet combination of the supply cassettes. In relation to these techniques, no mention is made regarding the treatment of the sheets to be removed through sheet supply. Further, in the method of Japanese Patent Application Laid-Open No. 2009-256076, when the attribute of sheets supplied to grouped sheet feeding cassette is changed, the sheet feeding cassette is temporarily removed from the group, whereby a situation is avoided in which ACC is impossible due to incompatibility in attribute. However, no mention is made either regarding the treatment of the sheet removed through sheet supply. Accordingly, when any of a plurality of users changes the kind and size of the sheets stored in the sheet feeding cassettes for some reason, the previous user, who is the user before setting change, is not notified of the changing status. Thus, in some cases, it can happen that the user, who has changed the sheet setting previously, cannot make out why he cannot execute printing processing with sheets feeding in accordance with his intention.

SUMMARY OF THE INVENTION

According to an aspect of the present invention, a printing system includes, a registering unit configured to register a plurality of sheet storage units each storing a sheet as one group, a determining unit configured, at the time of sheet supply to any one of the sheet storage units, to determine whether sheet information about the sheet storage unit set in the group has been changed by sheet information newly set with respect to the sheet storage unit to be supplied with the sheet, and a notifying unit configured, when the determining unit determines that the sheet information has been changed, to notify a user of the change in the sheet information about the sheet storage units set as one group by the supply of the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a diagram illustrating an example of a user interface (UI) screen displayed on an operation unit.

DESCRIPTION OF THE EMBODIMENTS

Various exemplary embodiments, features, and aspects of the invention will be described in detail below with reference to the drawings.

Figure 1:
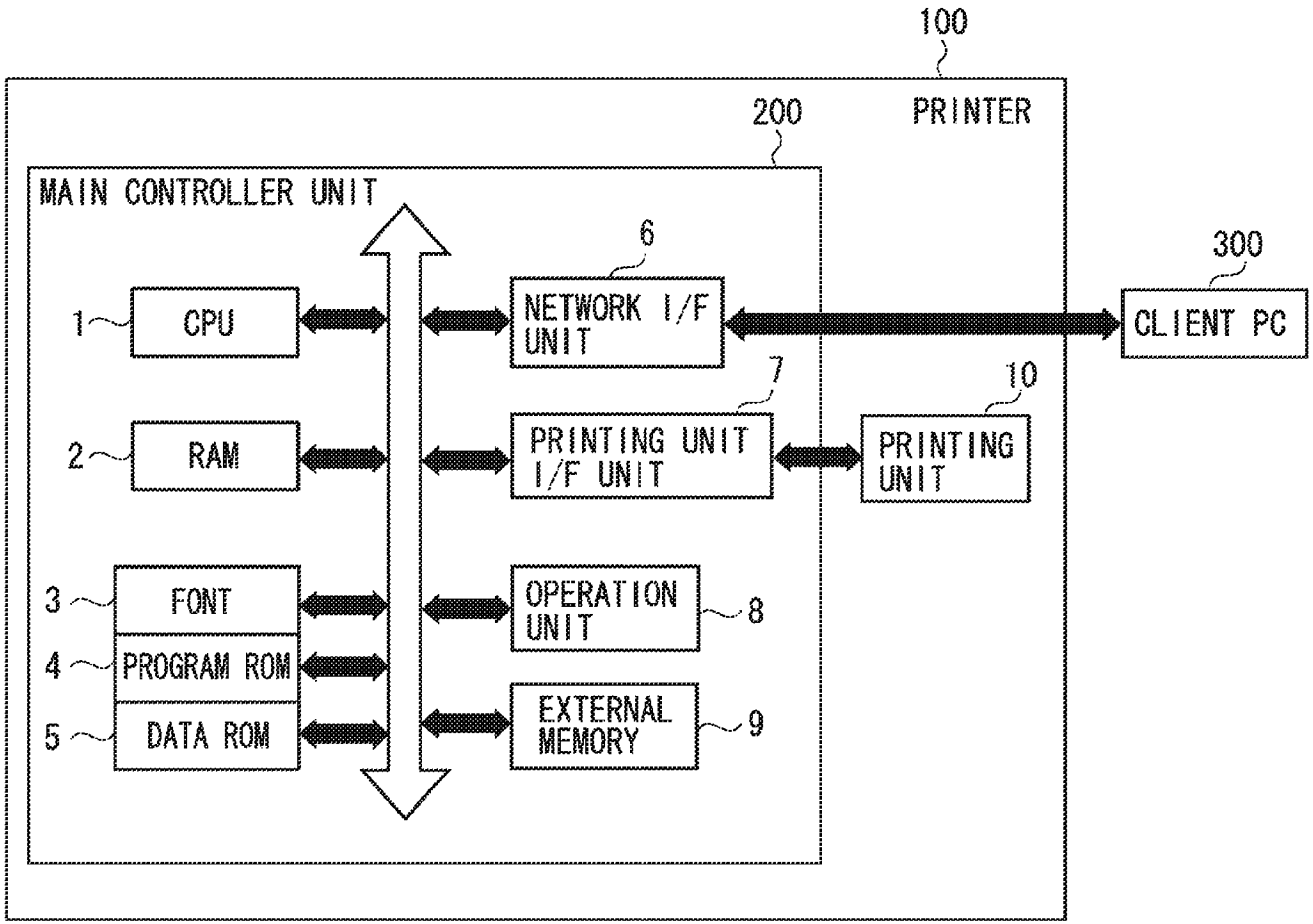
FIG. 1 is a block diagram illustrating the system configuration of a printing system.

A system configuration according to a first exemplary embodiment will be illustrated. FIG. 1 is a block diagram illustrating the system configuration of a printing system according to the present exemplary embodiment. In the system according to the present exemplary embodiment, communication is possible between a printer 100 and an information processing apparatus (client personal computer (PC)) 300. In the printing system of the present exemplary embodiment, a plurality of sheet storage units (sheet feeding cassettes) storing sheets are grouped for control.

In FIG. 1, the client PC 300 inputs a print job into the printer 100 via a network and a network interface (I/F) unit 6. An operating system (OS) is installed in the external memory of the client PC, and a central processing unit (CPU) loads the OS into a random-access memory (RAM). Then, various applications are executed to perform data processing. Further, a printer driver stored in the external memory is loaded into the RAM and executed by the CPU, whereby a print job is generated and output to the printer 100. Further, it is possible to notify the client PC 300 of a change in the condition of the printer 100 through the printer driver, and to know the progress of the print job through the network I/F unit 6.

The printer 100, which is an example of an image forming apparatus according to the present exemplary embodiment, includes a main controller unit 200 for controlling the printer 100, and a printing unit 10 configured to actually perform printing processing. The printing unit 10 includes a printing mechanism, a mechanical component such as a sensor, an electric circuit for controlling the mechanical component, and software (not illustrated).

In the main controller 200, the printing unit 10 and the main controller 200 are connected to each other by a printing unit I/F 7, being capable of transmitting a video signal for image formation, and reading a sensor value indicating the condition of the printing unit 10. The CPU 1 is a portion constituting the center of the main controller unit 200. It controls the printing unit 10 while writing and reading data to and from the RAM 2 according to a control program stored in a program read-only memory (ROM) 4, thereby realizing a printing operation.

Further, the main controller unit 200 is equipped with a font ROM 3 for expressing letters, and a data ROM 5 for storing fixed values. An external memory 9 is used for the storage of data of large capacity such as images. The external memory 9 also stores option software, etc. (not illustrated). An operation unit 8 is composed of an input key allowing the printer 100 to receive a command from the user, a liquid crystal display (LCD) panel for displaying the condition of the printer 100, etc.

Figure 2:
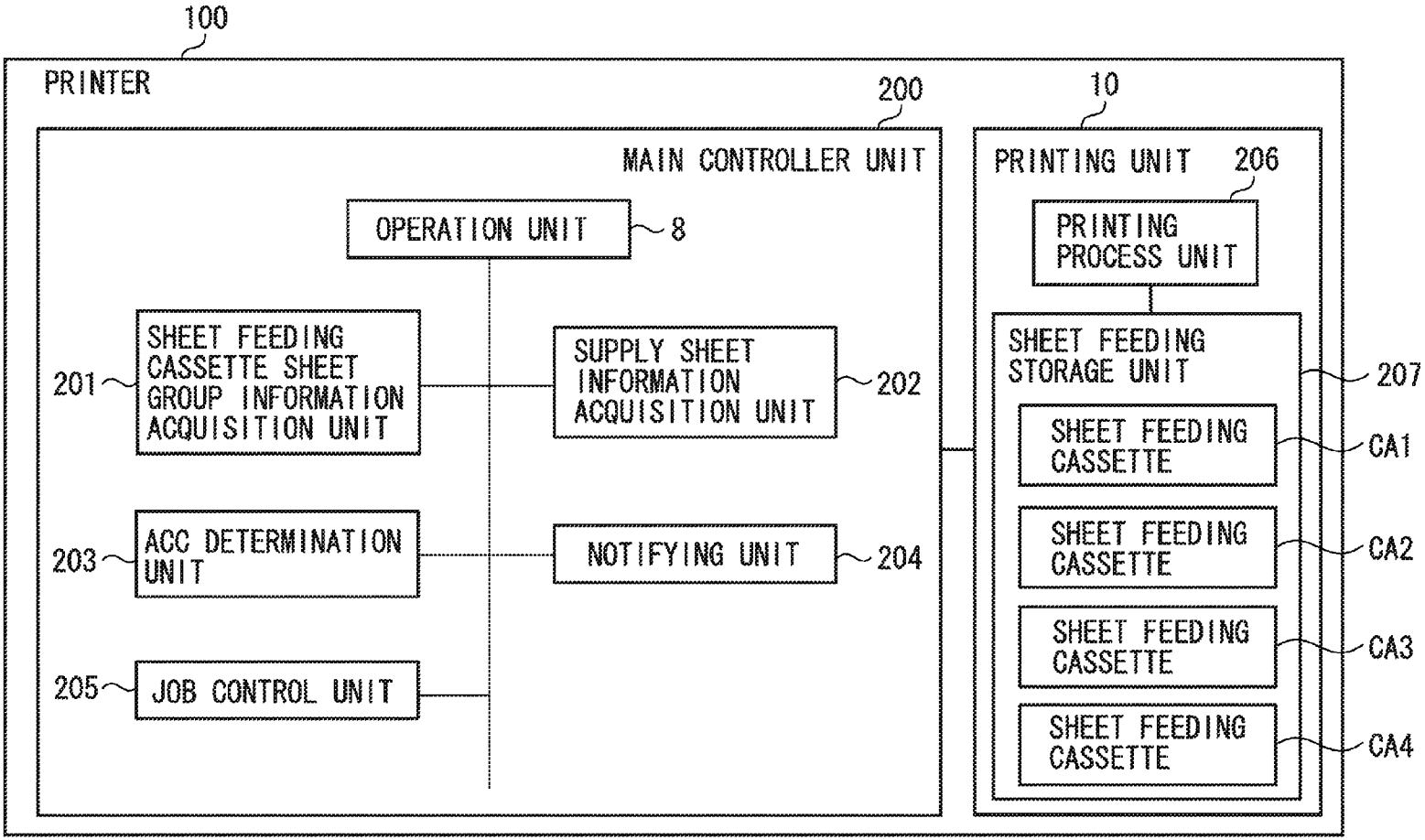
FIG. 2 is a block diagram illustrating the construction of a printer.

FIG. 2 is a block diagram illustrating the system configuration of the printer 100 illustrated in FIG. 1. A sheet feeding storage unit 207 and a printing process unit 206 are formed as hardware components included in the printing unit 10. Specifically, in FIG. 2, the sheet feeding storage unit 207 is composed of a plurality of sheet feeding cassettes CA1 through CA4 storing printing sheets.

Although FIG. 2 illustrates only one of them, the printer 100 can be provided with a plurality of sheet feeding storage units 207, and can store a large amount of sheets, being capable of performing large amount printing without stopping the printer 100 through execution of the ACC function. The printing process unit 206 performs an electrophotographic process on a sheet supplied from the sheet feeding storage unit 207 designated by a job control unit 205, generating an image thereon by using toner. Although they are important components for image formation and printing execution, the printing process unit 206 and the job control unit 205 are not directly related to the present invention, so a detailed description thereof will be left out.

A sheet feeding cassette sheet group information acquisition unit 201, a supply sheet information acquisition unit 202, an ACC determination unit 203, and a notifying unit 204 are software components stored in the program ROM 4. These are executed by the CPU 1, utilizing the RAM 2, the operation unit 8, the external memory 9, etc.

The sheet feeding cassette sheet group information acquisition unit 201 acquires information, retained in the external memory 9, about the sheets set in all the sheet feeding cassettes CA1 through CA4 existing in the sheet feeding storage unit 207, and stores the information in the RAM 2. The supply sheet information acquisition unit 202 acquires supply sheet information input by the user through the operation unit 8, and stores the information in the RAM 2. The ACC determination unit 203 determines how the environment for the execution of the ACC function varies in the CPU 1 based on the information acquired by the RAM 2 through the sheet feeding cassette sheet group information acquisition unit 201 and the supply sheet information acquisition unit 202. This determination will be described in detail below. The notifying unit 204 notifies the user of the determination result of the ACC determination unit 203 through the operation unit 8.

Figure 3:
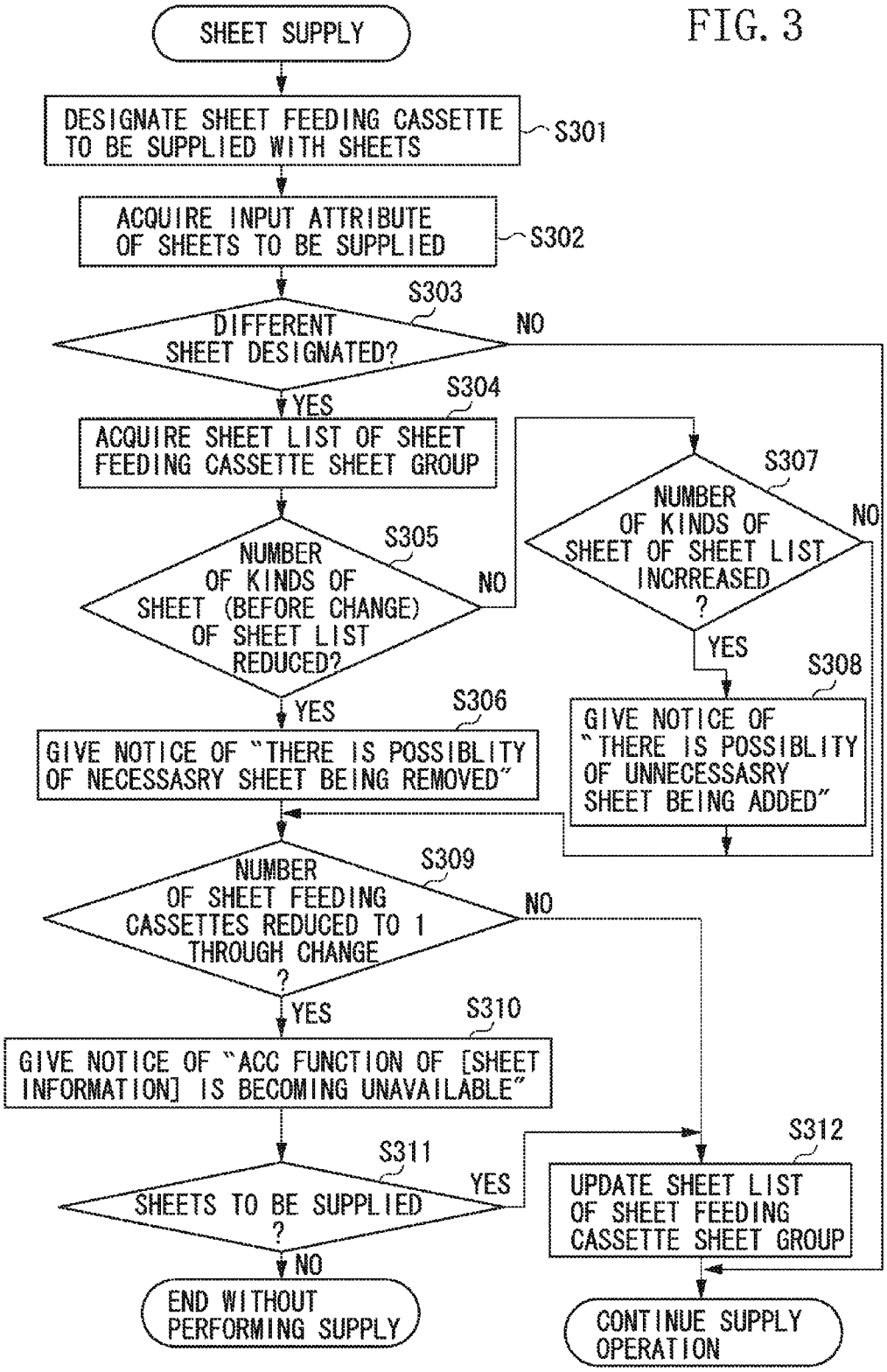
FIG. 3 is a flowchart illustrating a printing system control method.

FIG. 3 is a flowchart illustrating the printing system control method according to the present exemplary embodiment. In the present example, example of sheet feeding control, which is executed at the time of sheet supply is illustrated. The CPU 1 executes each step by loading the sheet feeding sheet group information unit 201, the supply sheet information acquisition unit 202, the ACC determination unit 203, and the notifying unit 204 from the program ROM 4 into the RAM 2 and by utilizing the operation unit 8, the external memory 9, and etc. In the following description, the module illustrated in FIG. 2 will be regarded as the subject of control. The present processing starts when the user supplies a sheet. It is generated with an arbitrary timing, when, for example, a certain sheet feeding cassette runs out of sheets, or when the user wishes to supply a desired sheet to an arbitrary sheet feeding cassette. First, in step S301, the supply sheet information acquisition unit 202 acquires sheet feeding cassette designation information input by the user through the operation unit 8. Further, in step S302, the supply sheet information acquisition unit 202 acquires attribute information about the kind of supply sheet input by the user through the operation unit 8, such as the size and type of sheet.

Subsequently, in step S303, the ACC determination unit 203 determines whether the sheet to be supplied is of the same attribute as the sheets that have been stored in the sheet feeding cassette until then, in other words, whether a different sheet has been designated. When, in step S303, the ACC determination unit 203 determines that there is no change in the sheet feeding cassette sheet information (NO in step S303), it means that the same sheet as before has been supplied. It is common that a sheet feeding cassette being used for printing runs out of sheets, making it necessary to supply sheets of the same kind. In this case, there is no change in the kind of sheet existing in the sheet feeding storage unit 207 before and after the supply, in other words, there is no change in the environment for the execution of ACC, so that the continuation of the supply operation is urged, and the present processing is completed.

On the other hand, when, in step S303, the ACC determination unit 203 determines that a different kind of sheet has been designated (YES in step S303), the combination of sheet groups of sheet feeding cassette existing in the sheet feeding storage unit 207 changes after the supply of the sheet. In other words, the environment for the execution of ACC also changes. Thus, it is determined in the subsequent processing how the environment for the execution of ACC has been changed through the change in sheet. For this purpose, in step S304, the sheet feeing cassette sheet group information acquisition unit 201 acquires a sheet list of the sheet group of the sheet feeding cassette. The sheet list is retained, for example, in the RAM 2. It is information about the attributes of all the sheet feeding cassette sheets existing in the sheet feeding storage unit. The list is updated each time the supply of sheets to the sheet feeding cassette is completed.

Next, in step S305, the ACC determination unit 203 compares the sheet group information of the sheet list with the information about the input supplied sheet in step S302. And, when the information about the supplied sheet feeding cassette sheet is updated, the ACC determination unit 203 determines whether the kinds of sheet that have existed in the sheet list prior to the updating decrease. Here, when the kinds of sheet group sheets that have existed prior to the updating decrease (YES in step S305), it means that the sheets that have been contained in only one sheet feeding cassette are to be eliminated.

Due to this change, it can happen that a sheet which is regarded as unnecessary by the user about to perform supply but which may be necessary for some other user, is eliminated. In view of this, in step S306, the notifying unit 204 notifies the user of the message: for example, "There is the possibility of a necessary sheet being removed" through the operation unit 8. On the other hand, when, in step S305, the ACC determination unit 203 determines that the kinds of sheet of the sheet group having existed in the sheet list prior to the updating do not decrease (NO in step S305), it means that a sheet of a certain one sheet supply cassette among the sheets contained in a plurality of sheet supply cassettes are removed.

Subsequently, in step S307, the ACC determination unit 203 determines whether the kinds of sheet group of the sheet list after the updating increase. When the ACC determination unit 203 determines that the kinds of sheet of the sheet list after the updating increase (YES in step S307), it means a new kind of sheet which has not existed in the sheet feeding storage unit 207 until then is added. Although it depends on the intention of the user in adding the sheet, the fact that a sheet which has not existed until then is added may mean it is a sheet that is not necessary for the user who has been utilizing the system in the sheet group combination adopted until then.

In view of this, in step S308, the notifying unit 204 notifies the user of the announcement: for example, "There is the possibility of an unnecessary sheet being added" through the operation unit 8. When the ACC determination unit 203 determines that the kinds of sheet of the sheet list after the updating do not increase (NO in step S307), it means a sheet of the kind already existing is added. By this change in sheet, it is to be expected at least that a sheet of the same kind as the sheet added still exists in some other sheet feeding cassettes. Since there is no change in the kinds of sheet existing in the sheet list, no particular announcement is made in this case, and the procedure advances to the next step.

Next, in step S309, the ACC determination unit 203 determines whether the number of the plurality of sheet feeding cassettes is reduced to one through the updating of the sheet list. Here, when the ACC determination unit 203 determines that the number of sheet feeding cassettes is not reduced to one (NO in step S309), this means the following: for example, when the same kind of sheets are being supplied to at least three or more sheet feeding cassettes, if one of the sheet feeding cassettes is changed to some other kind of sheet, there exist two or more sheet feeding cassettes containing sheets of the same kind. In this case, the number of sheets that can be used for the execution of ACC is reduced by the number of sheets in the sheet feeding cassette that has undergone the above change. However, the state is maintained in which ACC is possible for at least two or more sheet feeding cassettes. In other words, there is no change in the environment for the execution of ACC. Thus, no announcement is made here, and, in step S312, the ACC determination unit 203 updates the sheet list of the sheet feed cassette sheet groups to one to which information about newly supplied sheets is added, and the continuation of the supply operation is urged to complete the present processing.

On the other hand, when the ACC determination unit 203 determines that the number of the plurality of sheet feeding cassettes are reduced to one (YES in step S309), it means that, for example, of the sheets having been supplied to two sheet feeding cassettes, a different kind of sheets are supplied to one of the cassettes, with the result that the sheets only exist in one supply cassette. An environment in which even when one of a plurality of cassettes where sheets have existed runs out of sheets, ACC is executed without stopping printing through sheet supply from another sheet supply cassette, is changed to an environment in which it becomes impossible to execute ACC due to the reduction to one sheet feeding cassette through a change in sheet.

When a change to such an environment is to be made, in step S310, the notifying unit 204 notifies the user of a message: for example, "ACC function of [sheet information] is becoming unavailable" through the operation unit 8. Here, the size and type, for example, of the target sheet are indicated as the [sheet information], whereby the user can easily recognize for what kind of sheets ACC is becoming impossible. Next, when the notifying unit 204 notifies the user of the message, in step S311, an inquiry is made afterwards of the user as to whether supply is to be actually performed.

When, in step S311, the ACC determination unit 203 determines that a command to cease operation without executing supply has been input from the user (NO in step S311), the sheet list of the sheet feeding cassette sheet groups is not updated, and the processing is completed in that state. On the other hand, when, in step S311, the ACC determination unit 203 determines that the user has input a command to perform supply even if the message is notified (YES in step S311), the procedure advances to step S312. Then, in step S312, the sheet list of the sheet feeding cassette sheet groups is updated to one to which information about newly supplied sheets is added, and the continuation of the supply operation is urged to complete the present processing. As the method by which the notifying unit 204 notifies the user of the message, it is possible to notify the user at all the branching-off portions. However, in another method, it is also possible to allow the user to select the condition of notification, notifying the user according to that condition. FIG. 4 is a diagram illustrating an example of a user interface screen displayed on the operation unit 8 illustrated in FIG. 2. In the present example, the method in which the user is allowed to select the condition of notification is adopted, the example of the guidance which is presented for the user to select from a condition. In this example, the user is notified when the kinds of sheet of the sheet list are reduced and when a plurality of sheet feeding cassettes are reduced to a single sheet feeding cassette. However, no notification is made when the kinds of sheet of the sheet list increase.

Some users may find the notification of such message rather annoying, so that it is made possible to set whether notification is to be made according to the condition desired by the user, whereby the user is enabled to perform sheet supply operation without being annoyed.

A second exemplary embodiment will be described. In the printing system according to the above-described exemplary embodiment, no grouping setting is made on the sheet feeding cassettes CA1 through CA4. However, the present invention is also applicable to a printing system in which grouping setting has been made with respect to the sheet feeding cassettes CA1 through CA4. In the following, the exemplary embodiment of above printing system will be described. The description will be restricted to where the present exemplary embodiment differs from the first exemplary embodiment. In the present exemplary embodiment, it is possible to treat a plurality of sheet feeding cassettes as a group, with a printing system endowed with an ACC function being borne in mind.

By setting specific sheet feeding cassettes as in the same group, even in the case of a print job input designating a certain sheet feeding cassette, by utilizing the ACC function, it is possible to utilize another sheet feeding cassette in the group to which the designated sheet feeding cassette belongs. By thus grouping the sheet feeding cassettes, it is possible, for example, to divisionally set the sheet feeding cassette group to be used for each user. Thus, in the case where no sheet feeding cassette for another user is used or where it is undesirable that another user should use the sheet feeding cassette, it is possible to perform ACC operation as desired.

Figure 5:
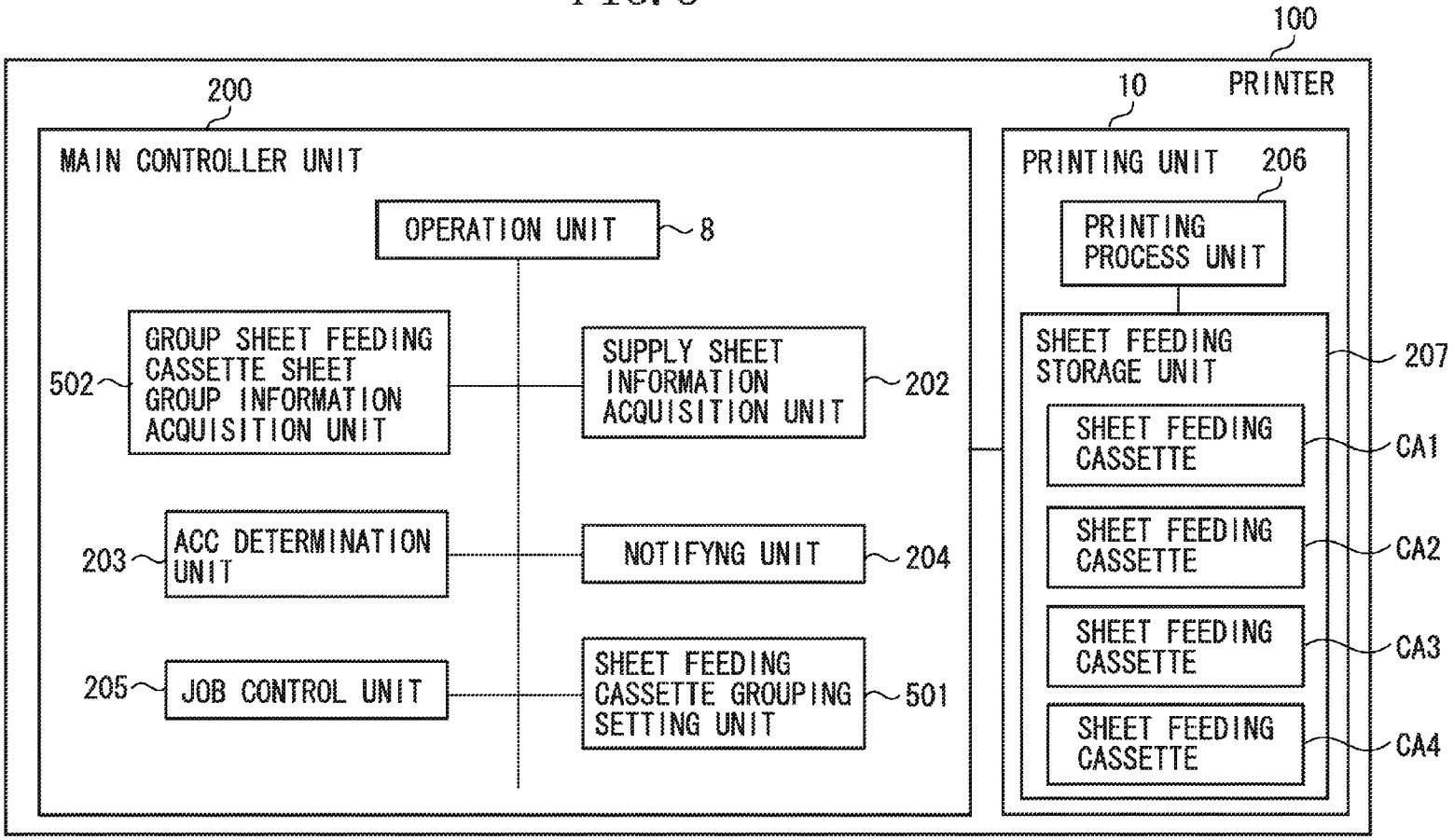
FIG. 5 is a block diagram illustrating the system configuration of a printing system.

FIG. 5 is a block diagram illustrating the system configuration of a printing system according to the present exemplary embodiment. In the present exemplary embodiment, in addition to the printing system configuration as illustrated in relation to the first exemplary embodiment, the printing system includes a sheet feeding cassette grouping setting unit 501 and a group sheet feeding cassette sheet group information acquisition unit 502. In FIG. 5, the sheet feeding cassette grouping setting unit 501 and the group sheet feeding cassette sheet group information acquisition unit 502 are software components stored in the program ROM 4, and are executed by the CPU 1 by utilizing the RAM 2, the operation unit 8, the external memory 9, and etc. The sheet feeding cassette grouping setting unit 501 receives the group setting of the sheet feeding cassette designated by the user, and stores information about each sheet feeding cassette and a group in the external memory 9. This processing is conducted each time the user changes the setting of the grouping, with the setting information being updated each time. The group sheet feeding cassette sheet group information acquisition unit 502 performs processing corresponding to the sheet feeding cassette sheet group information acquisition unit 201 in the first exemplary embodiment. While in the first exemplary embodiment the sheet group information about all the sheet feeding cassettes existing in the sheet feeding storage unit 207 is acquired, the group sheet feeding cassette sheet group information acquisition unit 502 acquires the sheet group information about the sheet feeding cassettes existing in the group to which the sheet feeding cassette constituting the supply target belongs.

Figure 6:
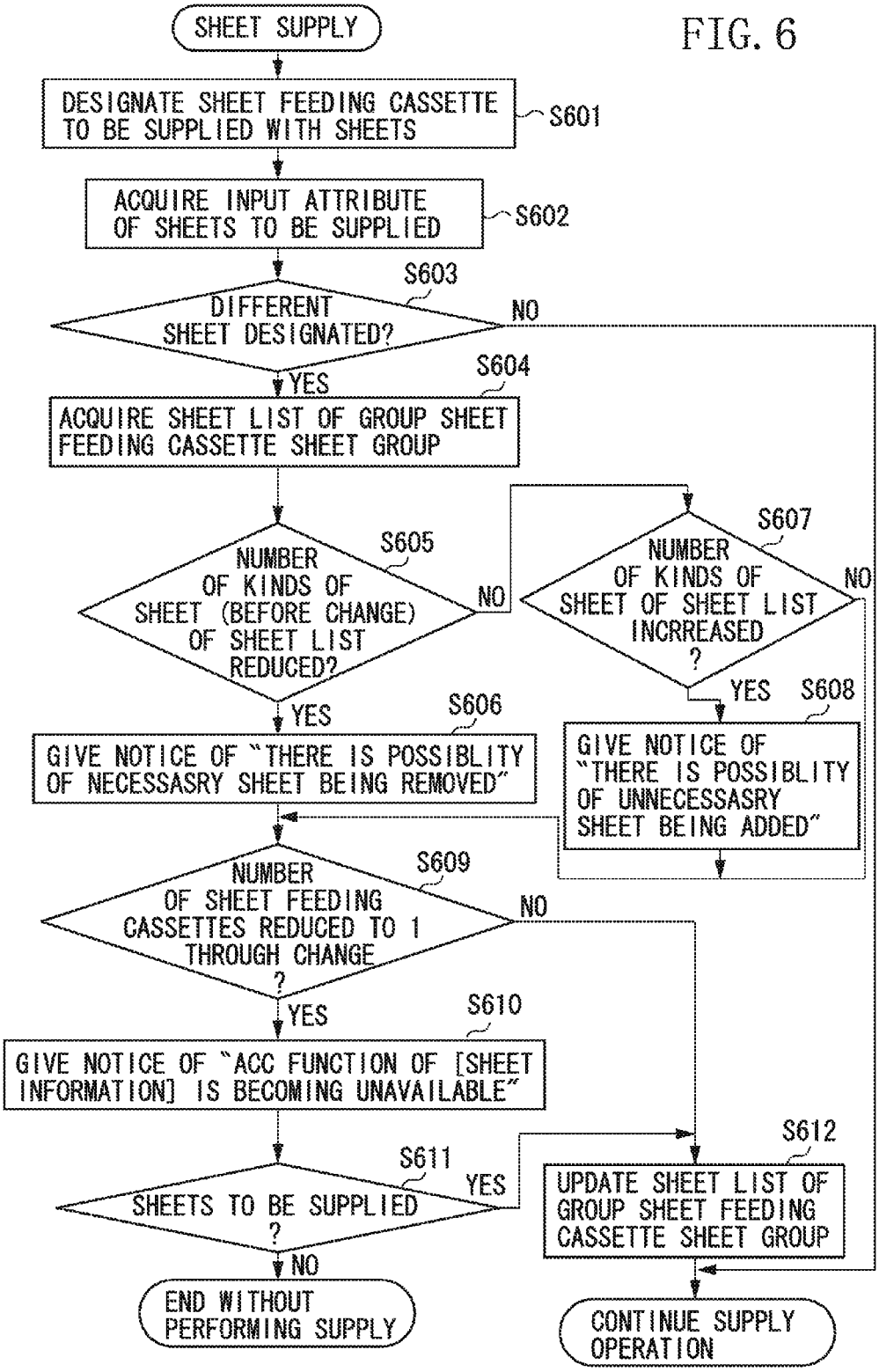
FIG. 6 is a flowchart illustrating a printing system control method.

FIG. 6 is a flowchart illustrating the printing system control method according to the present exemplary embodiment. In the present exemplary embodiment, an example of sheet feeding control executed at the time of sheet supply is described. The CPU 1 executes each step by loading the sheet feeding cassette sheet group information acquisition unit 201, the supply sheet information acquisition unit 202, the ACC determination unit 203, and the notifying unit 204 from the program ROM 4 into the RAM 2, and by utilizing the operation unit 8, the external memory 9, and etc. In the following description, the module as illustrated in FIG. 2 will be regarded as the subject of control. The difference from the steps illustrated in FIG. 3 lies in the processing in steps S604 and S612. In each of them, the contents of the sheet list to be acquired and updated deal with information about the sheet feeding cassette group to which the sheet feeding cassette to be supplied with sheets belongs. By executing the processing according to the present exemplary embodiment, the change in the ACC function due to the sheet supply is determined in the sheet feeding cassette existing in the group to which the sheet feeding cassette designated by the user and to be supplied with sheets belongs with respect to the plurality of grouped sheet feeding cassettes. As a result, in the case where grouping setting is made for allowing the sheet feeding cassettes to be properly used according to different users and different printing uses, it is possible to determine whether the ACC function is available within the range of the group without having to refer to information about the sheet feeding cassettes of groups other than that to which the sheet feeding cassette concerned belongs. Thus, it is possible to notify the user of the announcement of useful results obtained from among the supply sheet supply feeding cassettes available to the user.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., a non-transitory computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-190738 filed Sep. 1, 2011, which is hereby incorporated by reference herein in its entirety.

What is claimed is:

1. A printing system comprising:

a registering unit configured to register, as one group, sheet storage units from a plurality of sheet storage units, wherein, if an amount of sheets in a sheet storage unit in the one group becomes a predetermined amount, another sheet storage unit in the one group is used as a sheet feeding source;

a determining unit configured to determine whether kinds of sheets stored in the sheet storage units registered as the one group by the registering unit are reduced; and a notifying unit configured to provide notification when the determining unit determines that the kinds of sheets are reduced.

2. The printing system according to claim 1, wherein the notifying unit is configured, when it is determined, based on sheet information newly set with respect to the sheet storage unit to be supplied with the sheet, that a change to increase the kinds of sheet has been made by the sheet information about the sheet storage unit set in the group, to notify the user of the addition of a sheet not to be used in the sheet storage unit set in the group by the supply of the sheet.

3. The printing system according to claim 1, wherein the kinds of sheet is a size of the sheet.

4. A control method for controlling a printing system, the control method comprising:

registering, as one group, sheet storage units from a plurality of sheet storage units, wherein, if an amount of sheets in a sheet storage unit in the one group becomes a predetermined amount, another sheet storage unit in the one group is used as a sheet feeding source;

determining, whether kinds of sheets stored in the sheet storage units registered as the one group are reduced; and notifying, when it is determined that the kinds of sheets are reduced.

5. A non-transitory computer readable storage medium for storing a computer program for causing a computer to execute the control method according to claim 4.

6. The control method according to claim 4, wherein the kinds of sheets are sizes of sheets.

7. A printing system for conveying at least one sheet from at least one of a plurality of sheet storage units and printing images on the conveyed sheets, the printing system comprising:

a storage unit configured to store the sizes of the sheets set in the at least one of a plurality of sheet storage units;

a printing unit configured, when during the execution of printing using a sheet set in a first sheet storage unit included in the at least one of a plurality of sheet storage units, an amount of sheets of the first sheet storage unit becomes a predetermined amount or less, to change a sheet conveyance source from the first sheet storage unit to a second sheet storage unit according to the sizes stored in the storage unit and to continue printing;

a changing unit configured to change the size of the sheets set in at least one of the at least one plurality of sheet storage units stored in the storage unit; and a control unit configured, when, as a result of a change in size by the changing unit, the number of sheet storage units in which sheets of a specific size stored in the storage unit are set is changed from plural to singular, to give a warning to the user.

8. A printing system comprising:

a registering unit configured to register, as one group, sheet storage units from a plurality of sheet storage units, wherein, if an amount of sheets in a sheet storage unit in the one group becomes a predetermined amount, another sheet storage unit in the one group is used as a sheet feeding source;

a determining unit configured to determine, when a kind of a sheet stored for a sheet storage unit included in the sheet storage units registered as the one group by the registering unit is changed, whether the another sheet storage unit able to be used as the sheet feeding unit exists; and a notifying unit configured to notify a user in a case where the determining unit determines that the another sheet storage unit which is able to be used as the sheet feeding unit does not exist.

9. The printing system according to claim 8, wherein the notifying unit is configured to provide notification that switching a sheet storage unit used as the sheet feeding source even if the amount of sheets in the sheet storage unit in the one group becomes the predetermined amount is not possible.

10. The printing system according to claim 8, wherein the kind of sheet is a size of the sheet.

11. A printing system for conveying a sheet from one of a plurality of sheet storage units and printing images on the conveyed sheet, the printing system comprising:

a storage unit configured to store the sizes of the sheets set in the plurality of sheet storage units;

a printing unit configured, in a case where, during the execution of printing using a sheet set in a first sheet storage unit included in the plurality of sheet storage units, an amount of sheets of the first sheet storage unit becomes a predetermined amount or less, to change a sheet conveyance source from the first sheet storage unit to a second sheet storage unit according to the sizes stored in the storage unit and to continue printing;

a changing unit configured to change the size of the sheets set in one of the plurality of sheet storage units stored in the storage unit; and a control unit configured, in a case where, as a result of a change in size by the changing unit, the number of sheet storage units in which sheets of a specific size stored in the storage unit are set is increased or reduced, to give a warning to a user.

12. The printing system according to claim 11, wherein the control unit, as the result of the change in size by the changing unit, the number of sheet storage units in which sheets of the specific size stored in the storage unit are set is not increased or reduced, to control not to give the warning to the user.

* * * * *